US007192319B1

(12) United States Patent
Rahman et al.

(10) Patent No.: US 7,192,319 B1
(45) Date of Patent: Mar. 20, 2007

(54) INSULATED CABLE TERMINATION ASSEMBLY AND METHOD OF FABRICATION

(75) Inventors: Naeem Rahman, Bolingbrook, IL (US); Anthony Czyz, Schaumburg, IL (US); Mark Steven Hann, Shorewood, IL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/287,625

(22) Filed: Nov. 28, 2005

(51) Int. Cl.
*H01R 4/38* (2006.01)

(52) U.S. Cl. ..... 439/766; 439/621; 439/883

(58) Field of Classification Search ..... 439/621, 439/766, 765, 801, 883; 320/108; 336/DIG. 2
See application file for complete search history.

(56) References Cited

U.S. PATENT DOCUMENTS 5,216,402 A * 6/1993 Carosa ..... 336/66
6,902,434 B2 6/2005 Stack

* cited by examiner

*Primary Examiner*—Ross Gushi
(74) *Attorney, Agent, or Firm*—Armstrong Teasdale LLP

(57) ABSTRACT

A cable termination assembly includes a ring terminal with mechanically coupled insulating assembly electrically isolating a terminal post from the ring terminal. Methods of fabricating the assembly are also described.

27 Claims, 5 Drawing Sheets

INSULATED CABLE TERMINATION ASSEMBLY AND METHOD OF FABRICATION

BACKGROUND OF THE INVENTION

This invention relates generally to fuse assemblies, and more particularly, to cable termination assemblies for providing fused connections to storage battery terminal posts.

Fuses are widely used as overcurrent protection devices to prevent costly damage to electrical circuits. Fuse terminations typically form an electrical connection between an electrical power source and an electrical component or a combination of components arranged in an electrical circuit. One or more fusible links or elements, or a fuse element assembly, is connected between the fuse terminations so that when electrical current through the fuse exceeds a predetermined limit, the fusible elements melt and open one or more circuits through the fuse to prevent electrical component damage.

In vehicle electrical systems, storage batteries are used to power electrical circuits, and it is often desirable to protect the circuitry with fuses. The storage batteries typically include terminal posts, and fuses are sometimes fitted over the terminal posts. Ring terminals connected cables to are typically fitted over the fuses to supply power to auxiliary circuitry and devices of the vehicle. Known arrangements of this type are susceptible to undesirable shorting or bypassing of the current path through the fuse if the ring terminal is inadvertently brought into contact with the post, creating a direct current path from the post to the terminal without first passing through the fuse. Thus, despite the presence of the fuse in the circuit, component damage may result.

DETAILED DESCRIPTION OF THE INVENTION

Figure 1:
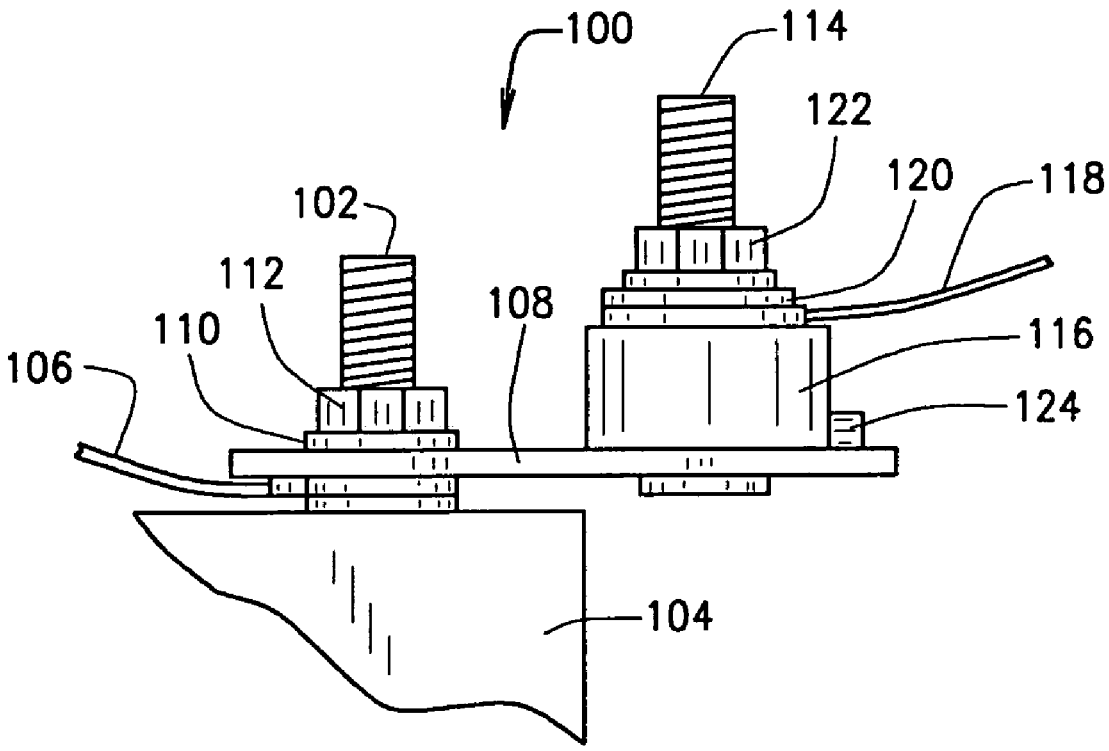
FIG. 1 PRIOR ART
FIG. 1 is an elevational view of a known battery fuse bus bar assembly.

FIG. 1 is an elevational view of known battery fuse bus bar assembly 100 coupled to a positive post terminal 102 of an exemplary vehicle storage battery 104. Such a battery 104 is known and commercially available from a variety of manufacturers, and as the construction and operation of battery 104 is readily appreciated by those in the art, further discussion thereof is omitted.

The assembly 100 includes a starter cable 106 coupled to positive battery terminal 102 for supplying electrical power from battery 104 to, for example, a vehicle starter motor (not shown). A conductive bus bar 108 is also coupled to positive battery terminal 102, and bus bar 108 and starter cable 106 are securely fastened to battery terminal 102 and to one another with a known fastener, such as washer 110 and nut 112 with threaded engagement.

The bus bar 108 extends from positive battery terminal 102 and in an exemplary embodiment includes a threaded terminal stud 114 attached thereto. The stud 114 provides for attachment of a known battery fuse 116 for supplying fuse protection to an auxiliary power supply cable 118 electrically connected to battery fuse 116. An insulative spacer element 120 electrically isolates battery fuse 116 and auxiliary power supply cable 118 from bus bar terminal stud 114, and is intended to prevent current flow from terminal stud 114 to auxiliary power supply cable 118 that would otherwise may circumvent the battery fuse 116. A flange nut 122 is coupled to terminal stud 114 and maintains spacer element 120, auxiliary power cable 118 and battery fuse 116 in position despite engine vibration and vehicle vibration for both internal and external influences as the vehicle is used. Further, the bus bar 108 includes an anti-rotation stop 124 projecting upwardly from a surface of bus bar 108 to prevent movement of fuse 116 relative to bus bar 108.

The fuse 116 may be, for example, a cubical-shaped fuse having a fusible link or fusible element therein that is constructed to melt, disintegrate, fail or otherwise open to break an electrical circuit through fuse 116. In normal operation, power drawn from battery 104 flows through bus bar 108 and through fuse 116 to auxiliary power cable 118 to auxiliary circuits or components. However, when current flow through fuse 116, or more specifically current flow through the fusible link or fusible element internal to fuse 116, approaches a predetermined level the fusible link or element opens the circuit through fuse 116 and prevents damaging current flow to the auxiliary circuits or components connected to auxiliary power supply cable 118.

In an exemplary embodiment, battery fuse 116 may be, for example a known FS-HVBF series 58V rated battery fuse available from Cooper Bussmann—Automotive Products of Chicago, Ill. Alternatively, the battery fuse 116 may be a known CF-58V fuse available from Wickmann USA of Atlanta, Ga. and internationally from the manufacturing division Wilhelm Pudenz GmbH of Dunsen, Germany. Still other fuses may be used in the assembly 100.

Assembly 100, through bus bar 108, provides a compact and localized connection to threaded post terminal 102 of battery 104 and a master fuse arrangement for auxiliary circuits and components. Fuse protection may be provided, for example, for amperages of about 50 A to about 300 A. The bus bar 108 is more completely described in commonly owned U.S. Pat. No. 6,902,434, the disclosure of which is hereby incorporated by reference in its entirety.

Figure 2:
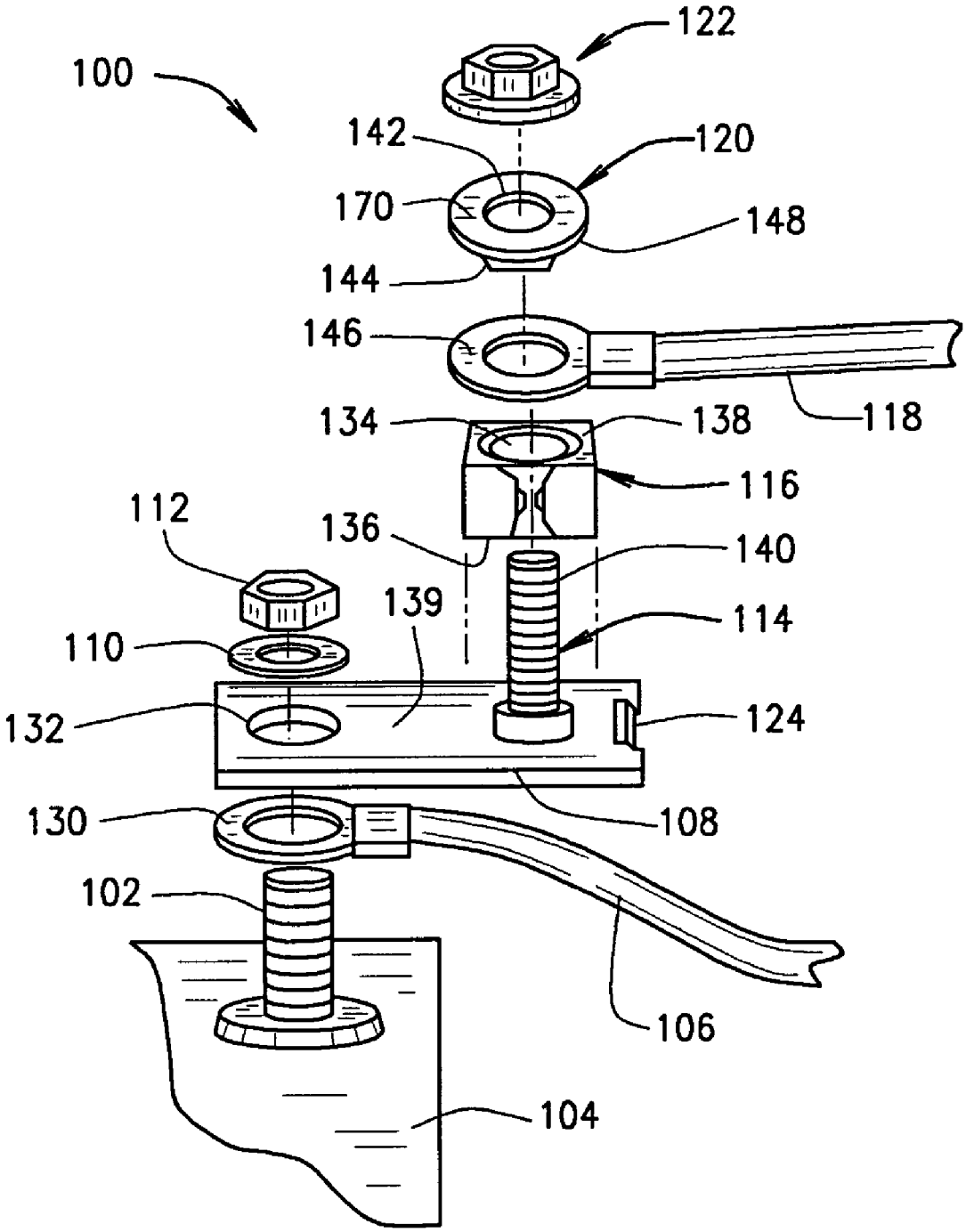
FIG. 2 PRIOR ART
FIG. 2 is an exploded view of the assembly shown in FIG. 1.

FIG. 2 is an exploded view of the battery bus bar fuse assembly 100 and whereby a method of assembling the assembly 100 is explained.

A ring collar 130 of starter cable 106 is inserted over positive threaded post terminal 102 of battery 104. The bus bar 108, with attached terminal 114 is then attached to battery terminal 102 by inserting positive battery terminal 102 through a battery terminal bore 132 in bus bar 108. Once battery terminal 102 is received in battery terminal bore 132, the bus bar 108 is attached to battery terminal 102 with washer 110 and nut 112 with threaded engagement as shown in FIG. 1.

Once the bus bar 108 is attached to battery terminal 102, the fuse 116 is inserted over terminal stud 114 and stud 114 is passed through a central opening 134 in fuse 116 until a lower bearing surface 136 of the fuse 116 contacts bus bar surface 138 and fuse 116 is seated upon bus bar 108 adjacent an anti-rotation stop 124. A ring collar 146 of the auxiliary power cable 118 is then inserted over the terminal 114 and in contact with an upper bearing surface 138 of the fuse 116. The spacer element 120 is then inserted over the terminal 114 such that a threaded portion 140 extends through a central bore 142 of the spacer element 120 and a neck section 144 of the spacer element 120 is extended through an auxiliary cable ring collar 146 and into a portion of opening 134 extending through the fuse 116. A bearing surface 148 of the spacer element 120 contacts an upper surface of auxiliary cable ring collar 146, and then flange nut 122 is attached to threaded portion 140 of terminal stud 114 and is tightened to securely fasten spacer element 120, auxiliary cable ring collar 146, fuse 116, and bus bar 108.

When assembled, current flows from the battery terminal 102, through the bus bar 108 to the fuse bearing surface 136, through the fuse 116 to the fuse bearing surface 138 and to the ring collar 146 through auxiliary cable 118 to auxiliary circuits or components. Proper operation of the assembly 100 to protect auxiliary cable 118 and associated components and circuits from damaging fault currents, however, is primarily dependent upon the correct installation and position of the spacer element 120. If the assembly 100 is not assembled correctly, short circuiting or bypassing of the fuse may result, resulting in electrical component damage despite the presence of the fuse 116.

Because the spacer element 120 is loose in relation to the ring collar 146, correct installation and positioning of the spacer element 120 in the assembly 100 cannot be assured. The spacer element 120 may be entirely omitted in the assembly through human error, or may be installed upside down or out of order with the other components in the assembly 100. Additionally, the spacer element 120 may become dislodged during assembly or installation or removal for service and repair. If any of these conditions occur, there is a potential for an undesirable short circuit to occur if the ring collar 146 touches the terminal stud 114, creating a direct current path from the terminal stud 114 to the ring collar 146 that bypasses the fuse 116.

Figure 3:
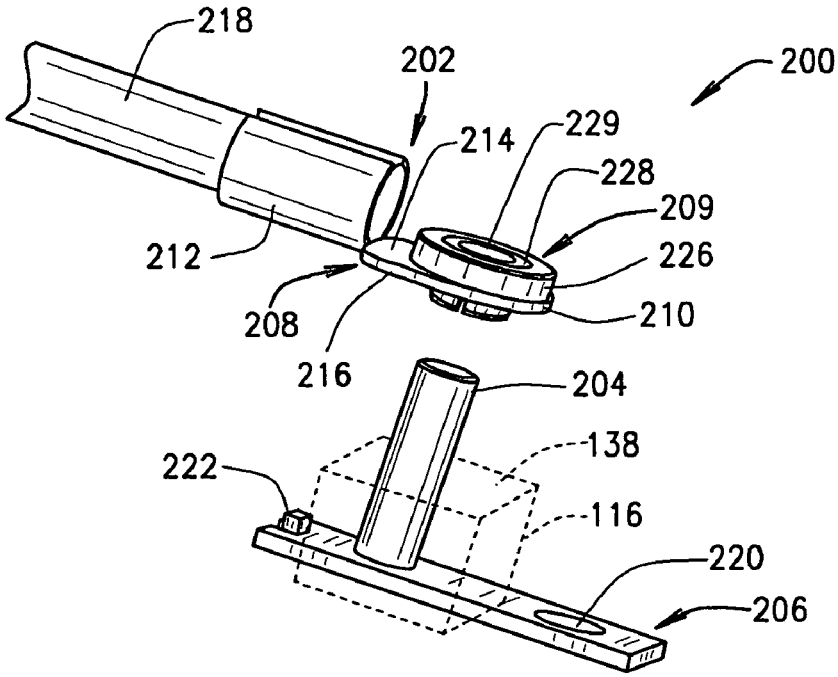
FIG. 3 is a perspective view of an exemplary cable termination assembly according to the present invention.

FIG. 3 is a perspective view of an exemplary cable termination assembly 200 according to the present invention, and that overcomes such difficulties in the manner explained below. The cable termination assembly 200 may be used in an assembly similar to the fuse bus bar assembly 100 described above, or alternatively may be used in another application wherein inadvertent electrical contact between a ring terminal and a terminal post is of concern. While the cable termination assembly 200 is believed to be especially advantageous when used with a fuse, such as the fuse 116 (shown in phantom in FIG. 3) to prevent shorting or bypassing of current through the fuse 116, the invention is not intended to be limited to a fuse assembly, such as the assembly 100 described above.

As illustrated in FIG. 3, the cable termination assembly 200 may include a ring terminal assembly 202, a terminal post 204 and an optional bus bar 206.

In an exemplary embodiment, the ring terminal assembly 202 may include a ring terminal 208 and an insulating assembly 209 that is mechanically mounted to the ring terminal 208 in a stationary manner. By fixing the insulating assembly 209 to the ring terminal 208, the relative positions of the ring terminal 208 and the insulating assembly 209 may be assured, and human error in installing, assembling or re-assembling during service or repair is largely avoided. Because of the mechanical coupling of the ring terminal 208 and the insulating assembly 209, when the ring terminal 208 is moved relative to the terminal post 204, the insulating assembly 209 is also moved, and the insulating assembly 209 may not be separated from the ring terminal 208 during installation, service or repair. The insulating assembly 209, as explained below, prevents shorting contact with the terminal post 204 that may establish a direct current path between the ring terminal 208 and the terminal post 204 that may bypass the fuse 116 and circumvent the overcurrent protection that the fuse 116 is intended to provide.

In an exemplary embodiment, the ring terminal 208 may include a generally flat collar portion 210 and a cable termination portion 212 extending from the collar portion 210. The collar portion 210 has opposing side surfaces 214, 216, and as seen in FIG. 3, the insulating assembly 209 extends outwardly from each of the side surfaces 214, 216 of the collar portion 210 to electrically isolate the collar portion 210 from the terminal post 204. The cable termination portion 212 in the illustrated embodiment is bent around the outer surface of a conductor, such as a wire or cable 218, with a known crimping tool. It is understood, however, that various other known cable termination techniques may be utilized to mechanically and electrically connect the cable termination portion 212 to the cable 218 with appropriate modification to the cable termination portion 212.

The terminal post 204, in different embodiments may be threaded or non-threaded as desired, and in an exemplary embodiment, is the type of terminal post commonly found in storage batteries for vehicles. The post 204 may be directly connected to a storage battery in a similar manner to the post 102 shown in FIGS. 1 and 2, or may be attached to a bus bar, such as the bus bar 206 to establish auxiliary power connections to a battery terminal post in a similar manner to the post 114 shown in FIGS. 1 and 2. The bus bar 206 may be similar to the bus bar 108 described above, and accordingly includes an opening 220 that may be inserted over, for example, the battery terminal post 102 shown in FIGS. 1 and 2. More than one terminal post 204 may be connected to the bus bar to accommodate additional connections, and an anti-rotation stop 222 may be provided in the bus bar 206 to maintain the fuse 116 in a predetermined position relative to the bus bar 206.

The insulating assembly 209 may include a collar 226 resting on the surface 214 of the ring terminal collar portion 210, and an insert 228 coupled to the collar 224 and extending through the ring terminal collar portion 210 and beyond the opposing side surface 216 of the ring terminal collar portion 210. The insert 228 includes a bore 229 that is dimensioned to receive the terminal post 204. When assembled, the terminal post 204 extends through the bore 229, and the lower surface 216 of the ring terminal collar portion 210 is brought into surface engagement with the bearing surface 138 of the fuse 116. A fastener, such as one of the nuts 112 and 122 shown in FIGS. 1 and 2, is then fitted over the end of the terminal post 204 and tightened to secure the assembly 200 together.

Figure 4:
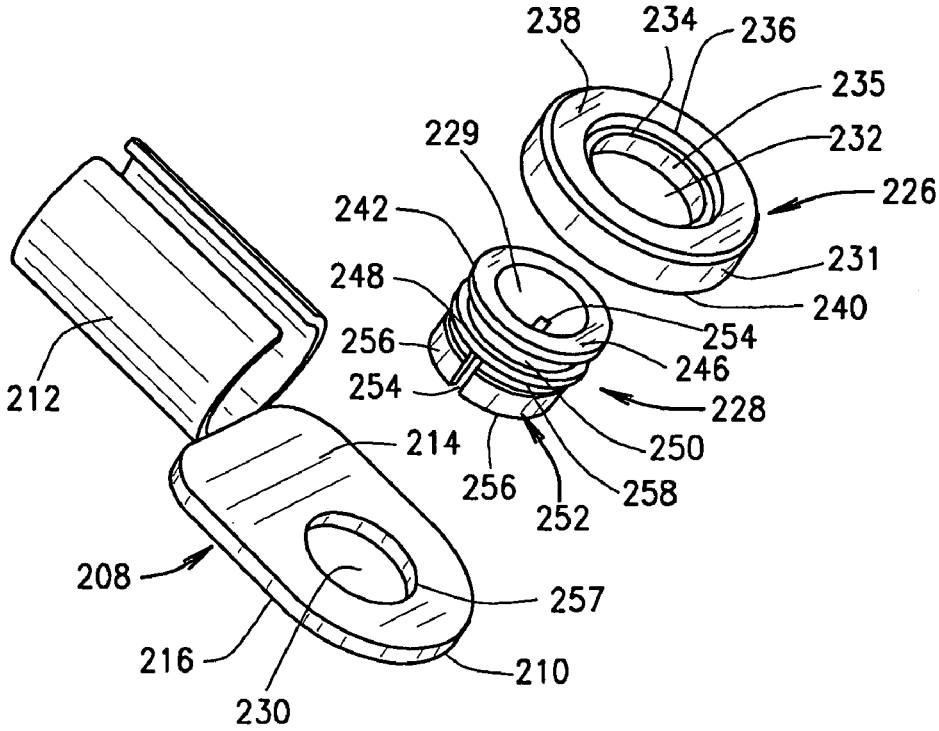
FIG. 4 is an exploded view of the ring terminal assembly shown in FIG. 3.

FIG. 4 is an exploded view of the ring terminal assembly 202 including the ring terminal 208, the collar 226, and the insert 228. The ring terminal collar portion 210 defines a generally circular opening 230 extending therethrough between the opposing side surfaces 214, 216 of the collar portion 210. The opening is dimensioned so that the terminal post 204 (FIG. 3) can be inserted therethrough. The ring terminal 208, including the cable termination portion 212, may be fabricated from a conductive material, such as tinned copper, according to known techniques, including but not limited to punching and stamping formation techniques. Alternatively, a variety of conductive materials, metals, and alloys may likewise be used to form the ring terminal 208 according to known techniques.

The collar 226 in an exemplary embodiment may include a body 231 shaped in the form of a toroid or disk with a central opening or bore 232 formed in a central portion thereof. The collar bore 232 is larger in diameter than the ring terminal bore 230 so that when the collar 226 is placed on the upper surface 214 of the terminal ring collar portion 210, the entire ring terminal bore 230 is accessible through the collar bore 232. An annular shelf 234 is formed in the body 231 adjacent an outer periphery 236 of the bore 232 and is recessed from a top surface 238 of the body 231. An annular rib 235 extends below the self 234, and a bottom surface 240 of the collar body 231 is flat and smooth. The top surface 238 provides a bearing surface for a fastener, such as a nut, used to retain the ring terminal assembly 202 to the terminal post 204. The bottom surface 240 provides a bearing surface for surface engagement with the upper surface 214 of the ring terminal collar portion 210.

In one embodiment, the collar 226 is fabricated from a nonconductive or insulative ceramic material according to known techniques. The ceramic collar is generally rigid and capably resists compressive forces and torque when, for example, a nut or other fastener is clamped down on the collar 226 when the assembly 200 (FIG. 3) is installed. It is contemplated, however, that the collar 226 may be fabricated from other materials in alternative embodiments.

The insert 228 may include a body 242 formed into a generally cylindrical or tubular shape including the central bore 229 that has a lesser diameter than the ring terminal bore 230. A rim 246 is formed at the top of the insert body 242, and an annular rib 248 projects outwardly from the body 242 at a distance from the rim 246. An annular groove 250 extends between rib 248 and the rim 246. The annular rib 235 of the collar 226 is fitted within the annular groove 250 of the insert 228 to retain the insert 228 to the collar 226. When the collar 226 and insert 228 are assembled, the insert rim 246 seats upon the annular shelf 234 of the collar 224, and the insert rim 246 is substantially flush with the collar top surface 238.

A deflectable skirt 252 depends downwardly from the rib 248, and axial slots 254 are formed in the skirt 252 and spaced from one another by approximately 90° to define resiliently deflectable tabs 256 between the slots 254. An outer diameter of the tabs 256 is greater than the diameter of the ring terminal bore 230, and by virtue of the slots 254 the tabs 256 are movable or deflectable in an inward direction when the insert 228 is fitted into the ring terminal bore 230. Once the tabs 256 clear the outer periphery 257 of the ring terminal bore 230, the tabs 256 resiliently return to their un-deflected position and a retaining groove 258 in the skirt 252 retains the insert 228 to the outer periphery 257 of the ring terminal bore 230 in an interlocking manner. Mechanical coupling of the insert 228 to the ring terminal 208 is therefore achieved with snap-fit engagement.

The insert 228 may be formed, for example, from a resilient non-conductive or insulating material such as plastic in an exemplary embodiment. Other resilient materials, however, may be employed in alternative embodiments of the invention. Additionally, non-resilient or rigid insulating materials may be utilized to fabricate the insert 228, and the insert 228 may be attached to the ring terminal 208 without snap-fit engagement if desired.

Figure 5:
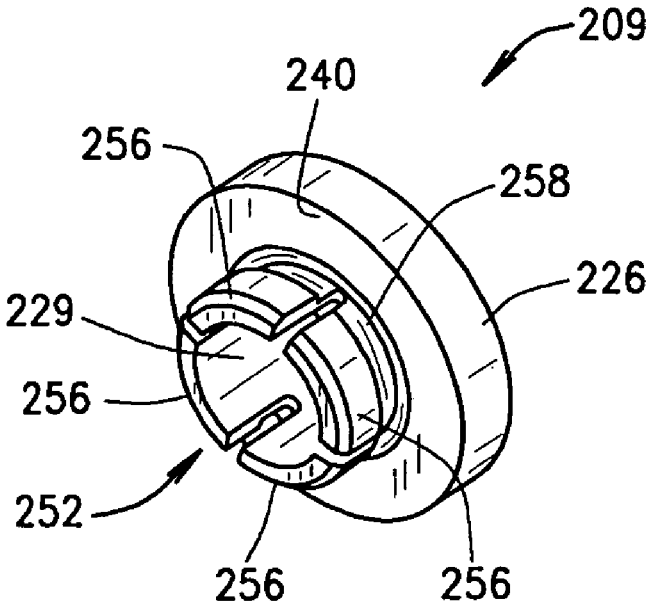
FIG. 5 is a perspective view of the insulator assembly shown in FIG. 4.

FIG. 5 is a perspective view of the insulator assembly 209 assembled to the collar 226. In the assembled condition, the insert skirt 252 extends outwardly from the bottom surface 240 of the collar 226, and the retaining groove 258 is adjacent the collar lower surface 240. By grasping the collar 226, the skirt 252 may be fitted into the ring terminal bore 230 (FIG. 4) and snapped onto the ring terminal. When the insert bore 229 is inserted over the terminal post 204 (FIG. 3), the insert 228 surrounds the terminal post 204 and extends between the terminal post and the inner edge of the ring terminal adjacent an outer periphery 257 (FIG. 4) of the ring terminal bore 230. Thus, whenever the ring terminal assembly 202 is coupled to the terminal post 204, the nonconductive insert 226 electrically isolates the ring terminal collar portion 210 from the terminal post 204, and the creation of a direct current path between the outer periphery of the terminal post 204 and the ring collar terminal portion 210 that may short or bypass the fuse 116 (FIG. 3) is prevented.

Figure 6:
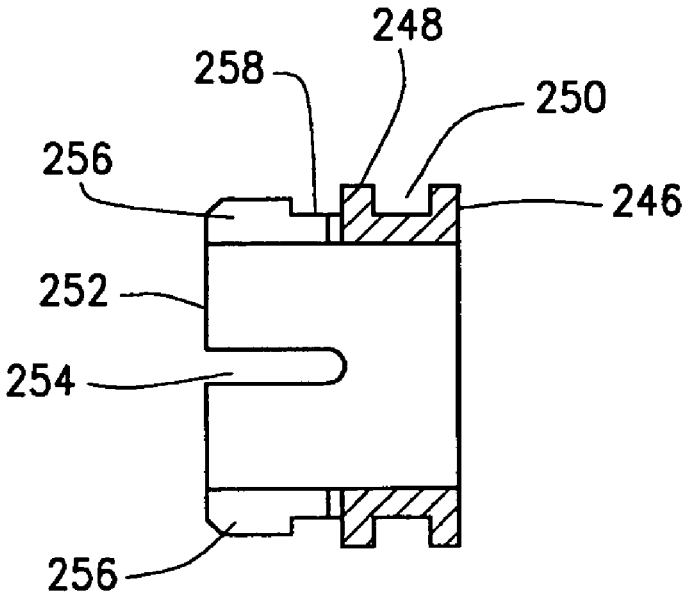
FIG. 6 is a cross sectional view of the insert shown in FIG. 5.

FIG. 6 is a cross sectional view of the insert 228 illustrating the rim 246 and the rib 248 with the annular groove 250 extending therebetween for retention of the collar 226 (FIGS. 4 and 5). The deflectable skirt 252, slots 254, and tabs 256 are also shown. (The sectional view shown in FIG. 6 passes through two of the slots 254 so only one slot is visible in FIG. 6.)

Figure 7:
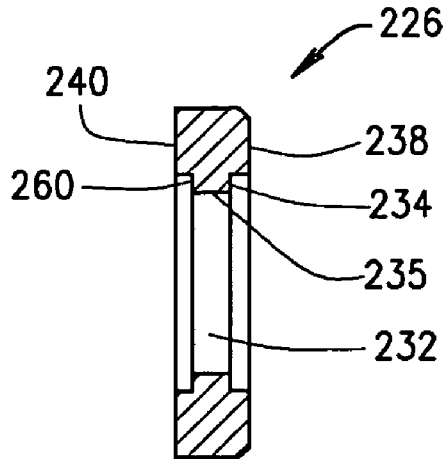
FIG. 7 is a cross sectional view of the collar shown in FIG. 5.

FIG. 7 is a cross sectional view of the collar 226 illustrating the shelf 234 recessed from the top surface 238 and the annular rib 235 projecting into the collar bore 232. Another shelf 260 opposes the first shelf 234 and is recessed from the bottom surface 240. The annular rib 235 extends between the shelves 234, 260. While the ribs and grooves illustrated in FIGS. 6 and 7 extend completely around the circumferences of the collar 226 and the insert 228, it is understood that in an alternative embodiment, the ribs and grooves need not extend entirely around the entire circumference of the collar 226 and insert 228, but rather may be separated into multiple segments having the same purpose and effect as the ribs and grooves described above.

Figure 8:
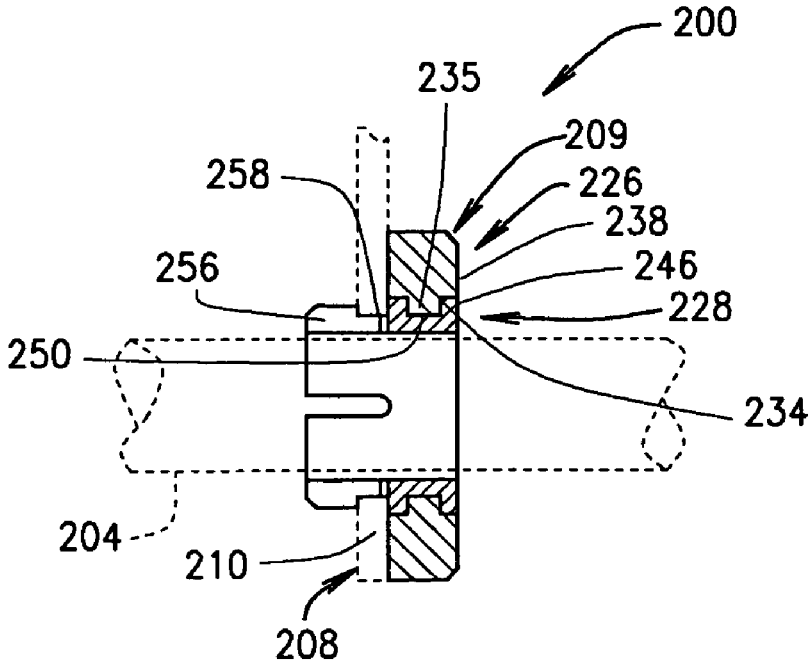
FIG. 8 is a cross sectional view of the insulator assembly shown in FIG. 5.

FIG. 8 is a cross sectional view of the cable termination assembly 200 showing the insulating assembly 209 with the insert 228 attached to the collar 226 and the assembly 209 attached to the ring terminal collar portion 210 (shown in phantom on FIG. 8). The collar rib 235 is fitted within the insert groove 250, and the insert rim 246 is seated on the collar shelf 234 in a substantially flush position with the collar top surface 238. The insert tabs 256 are inserted through the ring terminal bore 230 (FIG. 4) and the outer periphery 257 (FIG. 4) of the ring terminal bore 230 is seated in the insert retaining groove 258 to mechanically couple the insulating assembly 209 to the ring terminal 208. The interlocked ring terminal 208 and insulating assembly 209 prevents an inadvertent short circuit path between the ring terminal 208 and the terminal post 204 (also shown in phantom in FIG. 8) that may circumvent a fuse as described above during assembly/installation or removal of the ring terminal 208 in use. Proper assembly and placement of the insulating assembly 209 when used with a fuse 116 and terminal post 204 (FIG. 3) is likewise ensured.

Having now described the ring terminal assembly 202, an exemplary method of fabricating the assembly 202 will now be explained. The ring terminal 208 may be formed or otherwise provided and the insulating assembly 209 may be mounted to the ring terminal 208. The insulating assembly 209 may be formed by first forming or otherwise providing the rigid insulating collar 226, and then insert molding the resilient insert 228 about the collar 226 so that the two parts are permanently joined and securely fastened to one another. The insert 228 is formed with the skirt 252 and deflectable legs or tabs 256, and once the insulating assembly 209 is formed the skirt is fitted into the ring terminal bore 230, deflecting the tabs 256 and snapping the tabs 256 to the ring terminal collar portion 210. Once the insulating assembly 209 is fitted onto the ring terminal 208, the insulating assembly 209 is mounted stationary to the ring terminal 208, and the outer periphery 257 of the ring terminal bore 230 is covered by the insulating insert to provide an insulating barrier between the terminal post 204 and the outer periphery 257 of the ring terminal bore 230 where electrical contact between the terminal post 204 and the inner edges of the ring terminal collar portion 210 adjacent the ring terminal bore 230 might otherwise occur. Inadvertent shorting of the fuse 116 is thereby prevented.

In use, the rigid insulating collar 226 resists compressive forces and torque, while the resilient insert 228 allows press fit insertion to the ring terminal 208. This, while fabricating the collar 226 and insert 228 from different insulating materials results in the combination of structural strength and ease of installation, it is contemplated that the insulating collar 226 and the insert 228 may be fabricated from the same material while achieving at least some of the benefits of the invention. Additionally, it is understood that the construction of the insert skirt 252 may be varied as appropriate to include, for example, more or less slots 254 and tabs 256, and/or or different configurations of slots 254 and tabs 256 to provide varying degrees of resiliency for press fit insertion to the ring terminal 208. Additionally, the geometry of the insert body 242 and the collar body 231 may be varied, for example to polygonal or non-circular or cylindrical shapes to accommodate and complement ring terminal bores 230 having polygonal configurations or other geometric shapes while providing similar benefits as the illustrated round components described above. Thus, as used herein, the term "ring terminal" is not strictly limited to a terminal having a circular opening as depicted in the Figures. Rather, for purposes of this description, the term "ring terminal" is considered to include, for example, terminals having octagonal openings, polygonal openings or other non-circular openings One embodiment of a ring terminal assembly for a terminal post is disclosed herein. The assembly comprises a conductive ring terminal configured to connect to a cable and defining an opening therein configured to receive the terminal post. A nonconductive insulating assembly is fixed to the ring terminal and mounted to the opening, wherein the insulating assembly electrically isolates the conductive ring terminal from the post.

An embodiment of a cable termination assembly is also disclosed herein. The assembly comprises a terminal post and a conductive ring terminal defining an opening therein. The opening is dimensioned to receive the terminal post, and a nonconductive insulating assembly is mounted stationary to the ring terminal and mechanically coupled to the ring terminal at the outer periphery of the opening, whereby when the conductive ring terminal is moved the nonconductive insulating assembly moves together with the conductive ring terminal The insulating assembly is positioned between the terminal post and an edge of the ring terminal adjacent the opening when the ring terminal is inserted over the terminal post.

Another embodiment of a cable termination assembly is disclosed herein. The assembly comprises a terminal post, a fuse inserted over the terminal post, and a conductive ring terminal defining an opening therein. The opening is inserted over the terminal post and in surface engagement with the fuse, and a nonconductive insulating assembly is mounted stationary to the ring terminal. The insulating assembly comprises a first portion fabricated from a first non-conductive material and defining first and second annular grooves, and a second portion fabricated from a second material and defining an annular rib. The annular rib is received in one of the first and second annular grooves thereby retaining the first portion to the second portion, and the second portion extends away from the conductive ring terminal in a first direction. The outer periphery of the opening is received in the other of the first and second annular grooves thereby retaining the conductive ring terminal to the first portion, and the first portion extends through the opening and away from the conductive ring terminal in a second direction opposite to the first direction. The insulating assembly is positioned between the terminal post and an inner edge of the ring terminal adjacent the opening when the ring terminal is inserted over the terminal post.

A method of fabricating a cable termination assembly is also disclosed herein. The method comprises providing a conductive ring terminal having a first surface, a second surface and an opening extending between the first surface and the second surface; forming a nonconductive and resilient insert having a deflectable skirt; and fitting the deflectable skirt into the opening to mount the insulating assembly in a stationary position relative to the ring terminal, wherein the outer periphery of the opening is covered by the insert to prevent inadvertent electrical contact with the outer periphery of the opening.

Still another embodiment of a cable termination assembly is disclosed herein. The cable termination assembly comprises a terminal post, a ring terminal adapted to be inserted over the post, and means for insulating the ring terminal and preventing electrical connection between the terminal and the post when the ring terminal is inserted over the post. The means for insulating is mechanically coupled to and fixedly mounted to the post, whereby when the ring terminal is moved over the terminal, the means for insulating is moved with the ring terminal. Optionally, the means for insulating comprises a rigid portion and a resilient portion, and each of the rigid portion and the resilient portion extend from opposing surfaces of the ring terminal.

While the invention has been described in terms of various specific embodiments, those skilled in the art will recognize that the invention can be practiced with modification within the spirit and scope of the claims.

What is claimed is:

1. A ring terminal assembly for a terminal post, the assembly comprising:

a conductive ring terminal configured to connect to a cable and defining an opening therein configured to receive the terminal post; and a nonconductive insulating assembly fixed to the ring terminal and mounted to the opening;

wherein the insulating assembly electrically isolates the conductive ring terminal from the post; and wherein the ring terminal comprises opposed surfaces with the opening extending therebetween, the insulating assembly extending away from each of the opposed surfaces.

2. The termination assembly of claim 1, wherein the insulating assembly comprises a cylindrical insert having resilient tabs that are snap-fit to the opening.

3. The termination assembly of claim 1, wherein the insulating assembly comprises a first nonconductive portion defining an annular groove and a second nonconductive portion defining an annular rib, the rib positioned in said groove and retaining the first portion to the second portion.

4. The termination assembly of claim 1, wherein the insulating assembly comprises a body defining an annular groove, the groove receiving the ring terminal adjacent the opening to retain the insulating assembly to the ring terminal.

5. A ring terminal assembly for a terminal post, the assembly comprising:

a conductive ring terminal configured to connect to a cable and defining an opening therein configured to receive the terminal post; and a nonconductive insulating assembly fixed to the ring terminal and mounted to the opening;

wherein the insulating assembly electrically isolates the conductive ring terminal from the post; and wherein the insulating assembly comprises an insulating collar fabricated from a first insulating material, and an insulating insert fabricated from a second insulating material different from the first material.

6. A cable termination assembly comprising:

a terminal post;

a conductive ring terminal defining an opening therein, the opening dimensioned to receive the terminal post; and a nonconductive insulating assembly mounted stationary to the ring terminal and mechanically coupled to the ring terminal at the outer periphery of the opening, whereby when the conductive ring terminal is moved the nonconductive insulating assembly moves together with the conductive ring terminal;

wherein the insulating assembly is positioned between the terminal post and an edge of the ring terminal adjacent the opening when the ring terminal is inserted over the terminal post; and wherein the terminal post extends from a storage battery.

7. The termination assembly of claim 6, wherein the insulating assembly is fabricated from a resilient material and is adapted to snap-fit to the opening.

8. The termination assembly of claim 6, wherein the ring terminal comprises opposed surfaces with the opening extending therebetween, the insulating assembly extending away from each of the opposed surfaces.

9. The termination assembly of claim 6, wherein the insulating assembly comprises an insulating collar fabricated from a first insulating material, and an insulating insert fabricated from a second insulating material different from the first material.

10. The termination assembly of claim 6, wherein the insulating assembly comprises a first nonconductive portion defining an annular groove and a second nonconductive portion defining an annular rib, the rib positioned in said groove and retaining the first portion to the second portion.

11. The termination assembly of claim 6, wherein the insulating assembly comprises a body defining an annular groove, the groove receiving an edge of the ring terminal adjacent the opening retain the insulating assembly to the ring terminal.

12. The termination assembly of claim 6, further comprising a bus bar, the terminal post mounted to the bus bar.

13. The termination assembly of claim 6, further comprising a fuse, wherein a surface of the conducting ring terminal engages the fuse and the insulating assembly electrically isolates the conductive ring terminal from the terminal post.

14. A cable termination assembly comprising:

a terminal post;

a fuse inserted over the terminal post;

a conductive ring terminal defining an opening therein, the opening inserted over the terminal post and in surface engagement with the fuse; and a nonconductive insulating assembly mounted stationary to the ring terminal, the insulating assembly comprising a first portion fabricated from a first non-conductive material and defining first and second annular grooves, and a second portion fabricated from a second material and defining an annular rib;

wherein the annular rib is received in one of the first and second annular grooves thereby retaining the first portion to the second portion, the second portion extending away from the conductive ring terminal in a first direction;

wherein the outer periphery of the opening is received in the other of the first and second annular grooves thereby retaining the conductive ring terminal to the first portion, the first portion extending through the opening and away from the conductive ring terminal in a second direction opposite to the first direction; and wherein the insulating assembly is positioned between the terminal post and an inner edge of the ring terminal adjacent the opening when the ring terminal is inserted over the terminal post.

15. The termination assembly of claim 14, wherein the first portion comprises a cylindrical insert having resilient tabs that are snap-fit to the opening.

16. The termination assembly of claim 14, wherein when the conductive ring terminal is moved the nonconductive insulating assembly moves together with the conductive ring terminal.

17. The termination assembly of claim 14, wherein one of the first and second portions is fabricated from plastic.

18. The termination assembly of claim 14, wherein one of the first and second portions is fabricated from ceramic.

19. The termination assembly of claim 14, further comprising a bus bar, the terminal post mounted to the bus bar.

20. The termination assembly of claim 15, wherein the terminal post extends from a storage battery.

21. The termination assembly of claim 15, wherein a surface of the conducting ring terminal engages the fuse and the insulating assembly prevents the conductive ring terminal from establishing electrical connection with the terminal post when the conductive ring is inserted over the terminal post.

22. A method of fabricating a cable termination assembly comprising:

providing a conductive ring terminal having a first surface, a second surface and an opening extending between the first surface and the second surface;

forming a nonconductive and resilient insert having a deflectable skirt; and fitting the deflectable skirt into the opening to mount the insulating assembly in a stationary position relative to the ring terminal, wherein the outer periphery of the opening is covered by the insert to prevent inadvertent electrical contact with the outer periphery of the opening.

23. The method of claim 22, further comprising:

forming the insert with an annular ring; and snapping the ring onto the outer periphery of the opening.

24. The method of claim 22 wherein forming the insert further comprises:

providing a rigid collar; and molding the insert to the collar to permanently couple the collar to the insert.

25. A cable termination assembly comprising:

a terminal post;

a ring terminal adapted to be inserted over the post; and means for insulating the ring terminal and preventing electrical connection between the terminal and the post when the ring terminal is inserted over the post, the means for insulating being mechanically coupled to and fixedly mounted to the ring terminal, whereby when the ring terminal is moved over the terminal post, the means for insulating is moved with the ring terminal:

wherein the means for insulating comprises a rigid portion and a resilient portion, each of the rigid portion and the resilient portion extending from opposing surfaces of the ring terminal.

26. The cable termination assembly of claim 25, wherein the means for insulating comprises a first portion interlocked with a second portion by an annular rib and an annular groove, respectively.

27. The cable termination assembly of claim 25, wherein the means for insulating comprises a resilient insert adapted for snap fit insertion into the opening.

* * * * *